US008464647B1

(12) United States Patent
Chernek

(10) Patent No.: US 8,464,647 B1
(45) Date of Patent: Jun. 18, 2013

(54) PLASTIC PALLET

(76) Inventor: Frank Chernek, Yuma, AZ (US)

( * ) Notice: Subject to any disclaimer, the term of this patent is extended or adjusted under 35 U.S.C. 154(b) by 0 days.

(21) Appl. No.: 13/200,231

(22) Filed: Sep. 20, 2011

(51) Int. Cl.
*B65D 19/12* (2006.01)

(52) U.S. Cl.
USPC ..... 108/56.1; 108/56.3; 108/57.25

(58) Field of Classification Search
USPC ..... 108/57.25, 901, 902, 54.1, 53.3, 108/53.1, 53.5, 56.1, 56.3, 57.21, 57.22, 108/57.23, 57.24
See application file for complete search history.

(56) References Cited

U.S. PATENT DOCUMENTS

| | | | | |
|---|---|---|---|---|
| 2,287,740 | A * | 6/1942 | Klouman | 108/56.1 |
| 2,371,106 | A * | 3/1945 | Lewis et al. | 108/57.1 |
| 2,871,536 | A * | 2/1959 | Childress | 108/53.3 |
| 3,227,108 | A * | 1/1966 | Greaves | 108/53.3 |
| 3,272,158 | A * | 9/1966 | Barnum | 108/57.27 |
| 3,878,796 | A * | 4/1975 | Morrison | 108/901 |
| 4,145,976 | A * | 3/1979 | Svirklys | 108/56.1 |
| 4,485,744 | A * | 12/1984 | Umemura et al. | 108/57.18 |
| 4,694,962 | A * | 9/1987 | Taub | 108/54.1 |
| 5,101,737 | A * | 4/1992 | Gomez | 108/57.18 |
| 5,367,960 | A * | 11/1994 | Schleicher | 108/57.32 |
| 5,440,998 | A * | 8/1995 | Morgan et al. | 108/57.18 |
| 5,662,048 | A * | 9/1997 | Kralj et al. | 108/56.3 |
| 5,676,067 | A * | 10/1997 | Breindel | 108/56.1 |
| 5,941,179 | A * | 8/1999 | Herring | 108/57.19 |
| 6,766,749 | B2 * | 7/2004 | Lacabanne | 108/56.3 |
| 6,837,170 | B2 * | 1/2005 | Taft | 108/57.25 |
| 6,938,558 | B1 * | 9/2005 | Peres | 108/56.3 |
| 7,469,643 | B2 * | 12/2008 | Isle et al. | 108/57.25 |
| 2009/0145339 | A1 * | 6/2009 | Dubois et al. | 108/56.1 |

* cited by examiner

*Primary Examiner* — Jose V Chen
(74) *Attorney, Agent, or Firm* — Richard K. Thomson

(57) ABSTRACT

A plastic pallet suitable for stacking firewood, camping gear, and the like, above a concrete floor or in the attic, includes at least two longitudinal stringers and a plurality of four-sided open-box slats, the sides of which taper outwardly from the upper surface to afford a stackable profile. The slats assemble to the stringers without the need of tools or independent fasteners. The ends of each stringer are formed with interlocking profiles which allow the length of the pallet to be extended, as desired.

13 Claims, 9 Drawing Sheets

PLASTIC PALLET

BACKGROUND AND SUMMARY OF THE INVENTION

The present invention is directed to the field of storage. More particularly, the present invention is directed to a plastic pallet which can be utilized by the consumer for various household applications. The pallet of the present invention is particularly suited for storing dry goods in wet/damp environments: fire wood, sacks of cement, tents, RV/camping supplies, etc., above garage floors, in attics, or the like.

The present invention comprises a plastic pallet comprising a) at least two longitudinally extending stringers defining the length of the plastic pallet; b) a plurality of laterally extending slats interconnected to the stringers, each of the slats having a first overall length and comprising i) a longitudinal upper face extending substantially the entire first overall length of the slat, ii) four-sided open-box construction including a side extending downwardly and tapered outwardly from each edge of the longitudinal upper face; iii) a series of laterally extending ribs each rib protruding from a lower surface of the upper face a limited extent into the open-box construction; whereby prior to assembly with the at least two longitudinally extending stringers, the slats may be nested to form a stack.

An additional feature of the plastic pallet of the present invention is that each of the at least two longitudinally extending stringers has a first end with a contoured notch and a second end having a complementarily shaped contoured protrusion which interlocks in the contoured notch effectively extending the length of the plastic pallet.

A third feature of the plastic pallet of the present invention comprises a. first attachment means formed on an upper surface of each of the longitudinally extending stringers; b. each of the plurality of laterally extending slats having a series of second attachment means formed on a lower surface of each laterally extending slat, the series of second attachment means being equal in number to the number of the plurality of longitudinally extending stringers; whereby the second attachment means of each of the plurality of laterally extending slats can be secured to the first attachment means of each of the plurality of longitudinally extending stringers to secure each of the laterally extending slats to the longitudinally extending stringers without utilizing any additional independent fasteners.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
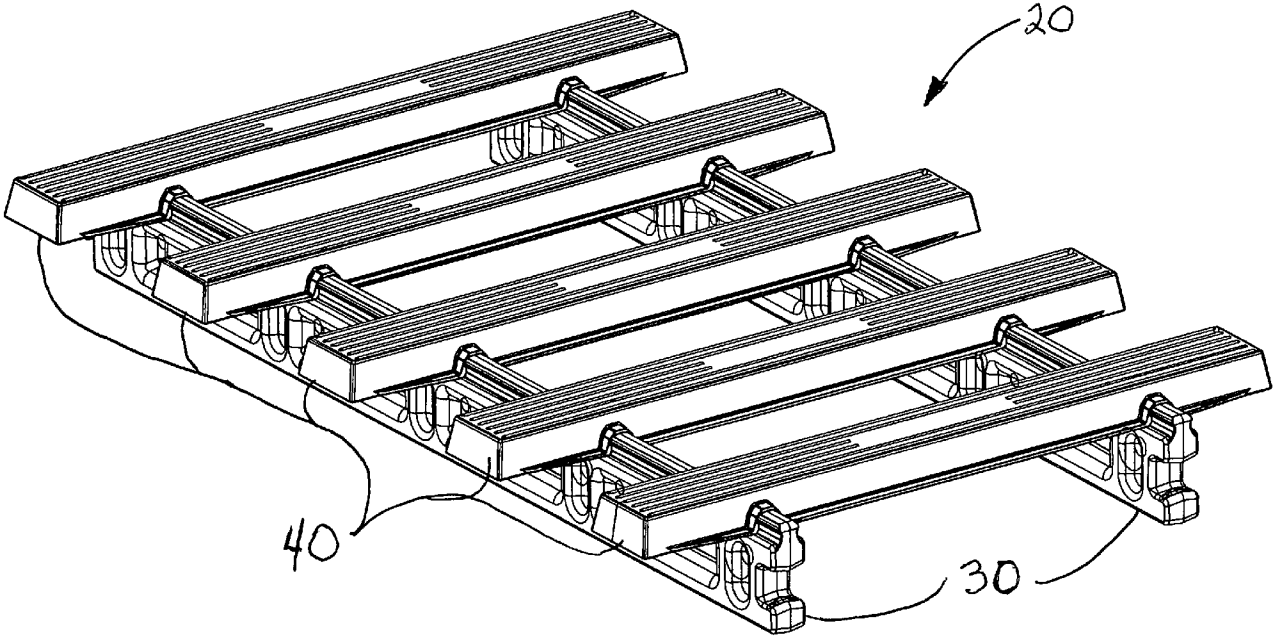
FIG. 1 is a front perspective view of a first embodiment of the plastic pallet of the present invention.

A first embodiment of the plastic pallet of the present invention is depicted in FIG. 1 generally at 20. Plastic pallet 20, being marketed under the trademark "E-Z Pallet", comprises at least two stringers 30 and a plurality (five being shown) of slats 40. The actual commercial pallet will be shipped unassembled with two stringers 30 and four slats 40. The material of choice for the stringers 30 and slats 40 is polypropylene. Alternatively, high density polyethylene (HDPE) could be used.

Figure 4:
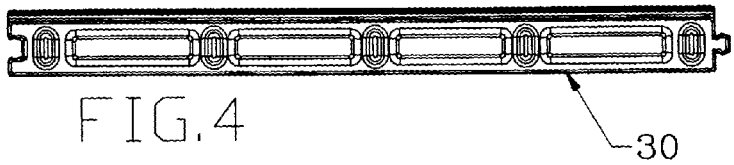
FIG. 4 is a front view of the stringer of the first embodiment of the plastic pallet.
Figure 4A:
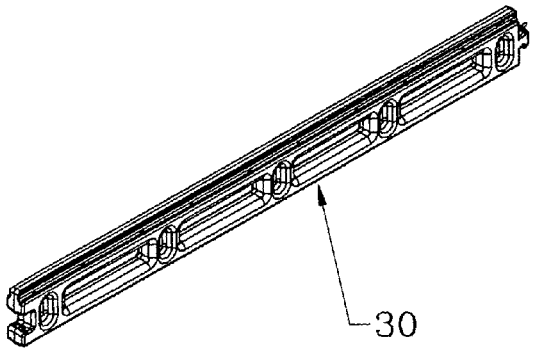
FIG. 4A is a front perspective view of the stringer of the first embodiment.
Figure 4B:
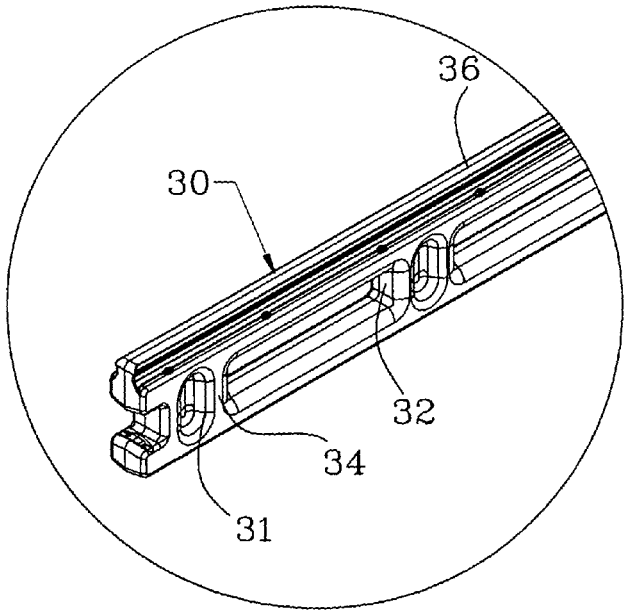
FIG. 4B is an enlarged closeup view of a portion of the stringer shown in FIG. 4A.
Figure 5:
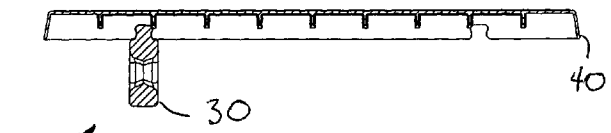
FIG. 5 is a cross-sectional side view of the plastic pallet of the present invention.
Figure 5A:
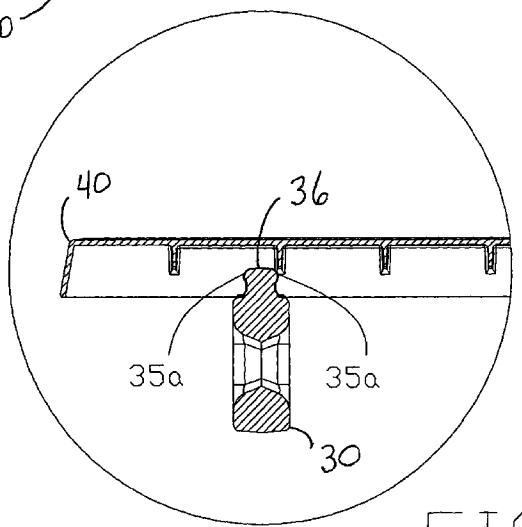
FIG. 5A is an enlarged closeup view of a portion of the plastic pallet shown in FIG. 5.

Stringers 30 (FIG. 4B) are preferably blow-molded and have a first series of cutouts 31 which alternate with a second series of larger cutouts 32 to reduce the amount of material necessary to manufacture each stringer 30. Alternating cutouts 31 and 32 where the material is folded together to produce columns 34 which provide the vertical strength needed to hold up under the loads (up to 500 lbs) placed on the plastic pallet 20. A rail 36 is formed along the upper edge of stringer 30 and forms a first attachment means. Rail 36 has a pair of protruding ears 35*a* (FIG. 5A) which serve to retain slats 40 atop rail 36.

Figures 2, 3A, 3B, 3C:
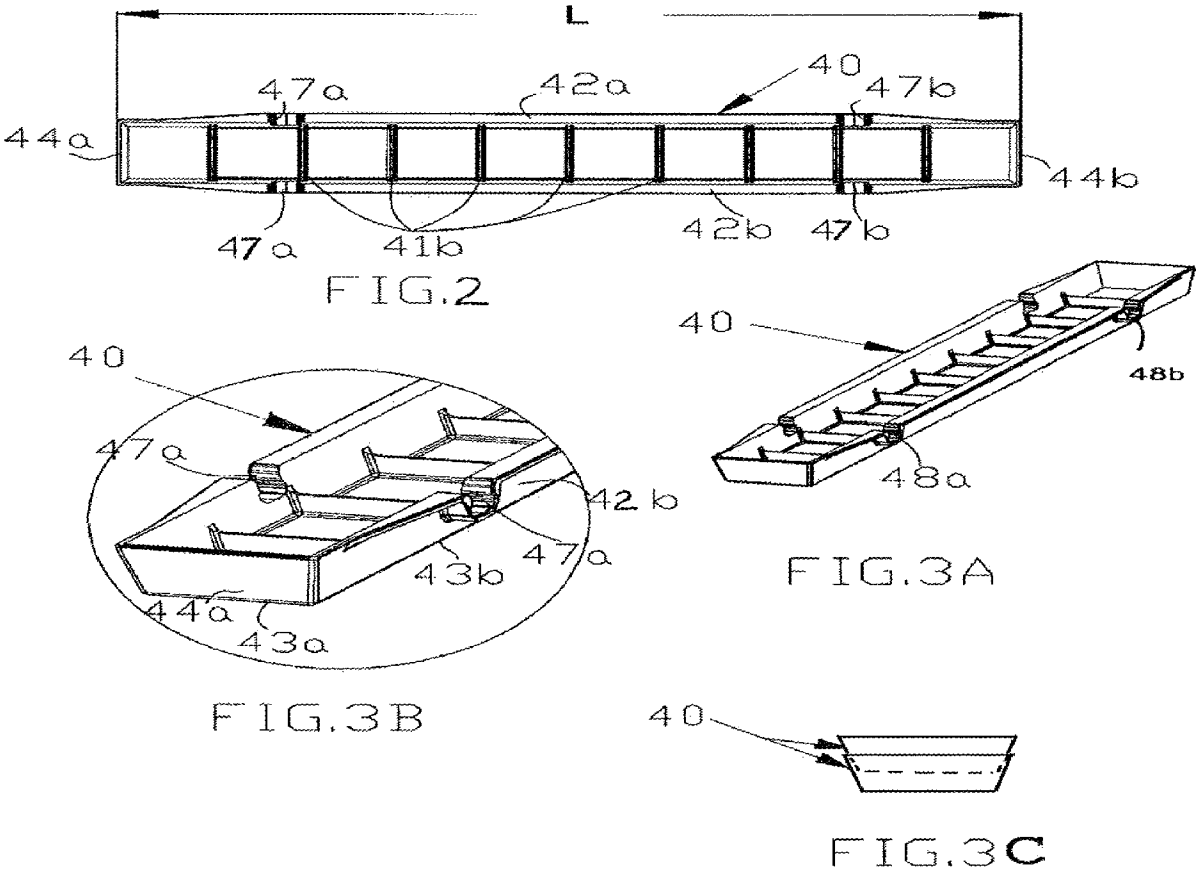
FIG. 2 is a bottom view of the slat of the first embodiment.
FIG. 3A is a perspective view of the slat shown in FIG. 2.
FIG. 3B is an enlarged closeup view of a portion of the slat shown in FIG. 3A.
FIG. 3C is a schematic end view depicting two nested slats.
Figure 6:
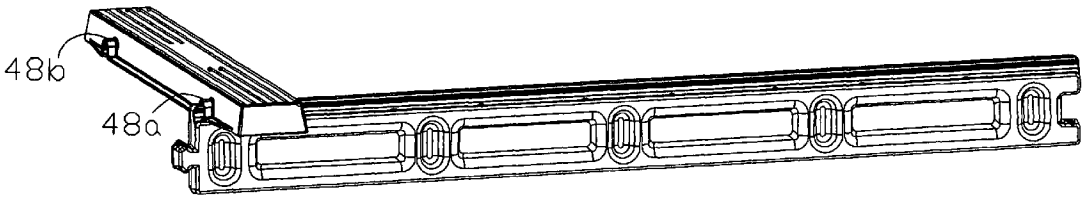
FIG. 6 is a front perspective view of a portion of the first embodiment of plastic pallet.
Figure 6A:
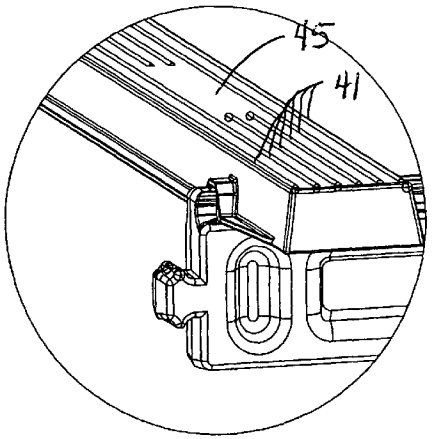
FIG. 6A is an enlarged closeup view of a portion of the plastic pallet shown in FIG. 6.

As best seen in FIGS. 2-3B, slats 40 comprise members which have a first overall length L made up of a four-sided open-box construction including an upper face 45 (FIG. 6A) extending substantially the entire first overall length L (FIG. 3), two sides 42*a*, 42*b* and two ends 44*a*, 44*b* extending downwardly from each edge portion 43*a*, 43*b*, respectively, of upper face 45 with a slight outward taper which facilitates the stacking of a plurality of slats 40 for shipping. The four-sided open box construction of slat 40 significantly reduces the material necessary for manufacture (as compared to an enclosed box construction) without materially reducing the strength or other physical properties of the slat 40. As depicted in FIG. 3C, the nestability of slats 40 can significantly reduce the size of the package required to ship the unassembled components of plastic pallet 20 which also reduces the costs associated with shipping. A plurality of laterally extending ribs 41*b* afford slats 40 with enhanced rigidity reinforcing upper face 45 and preventing sides 42 from bowing inwardly or outwardly. Longitudinal ribs 41 provide a slip resistant surface to upper face 45.

Figure 7:
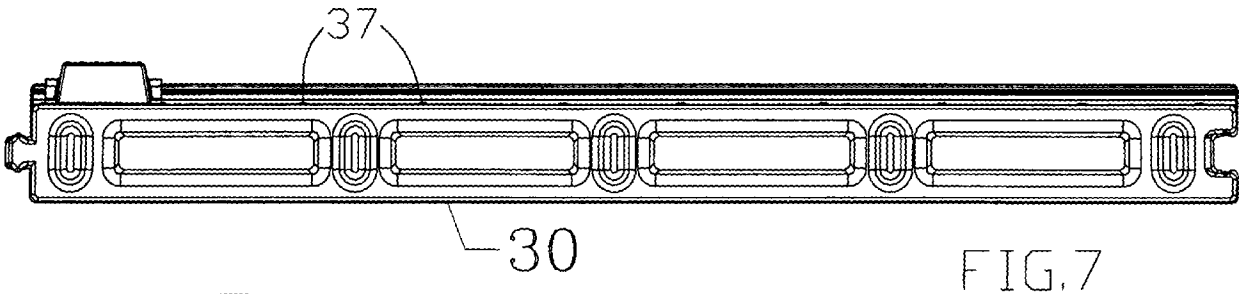
FIG. 7 is a side view showing a slat engaged with a stringer.
Figure 7A:
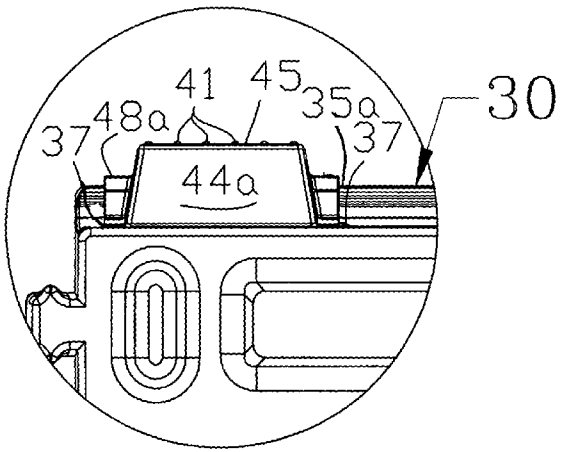
FIG. 7A is an enlarged closeup of a portion of the plastic pallet shown in FIG. 7.
Figure 9A:
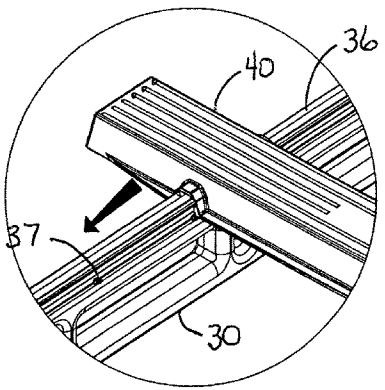
FIG. 9A is an enlarged closeup of a portion of a slat being assembled onto a rail.
Figure 9:
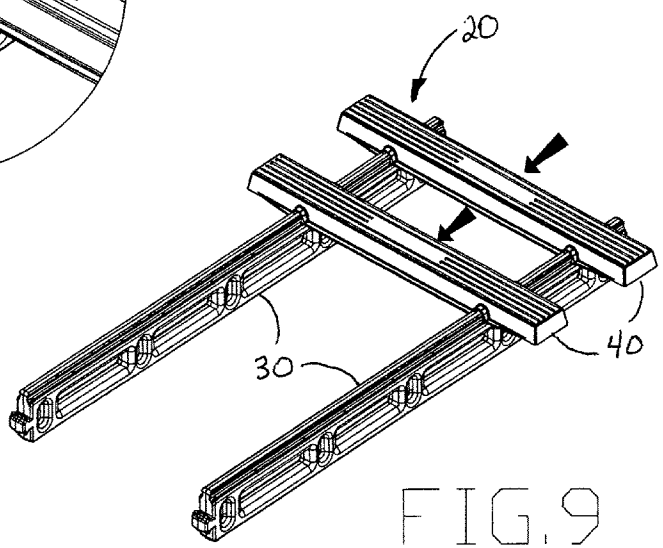
FIG. 9 is a perspective view showing slats being assembled to the stringers in a first direction.
Figure 10:
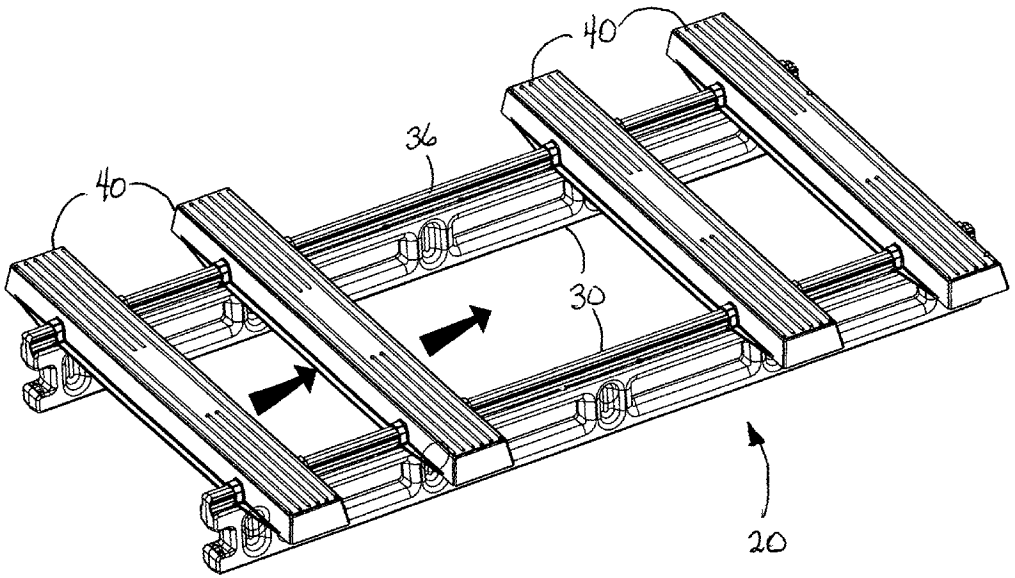
FIG. 10 is a perspective view showing two slats being assembled to the stringers from the opposite direction.

A first pair of laterally aligned notches 47*a* in sides 42*a*, 42*b* adjacent first end 44*a* and a second pair of laterally aligned notches 47*b* adjacent second end 44*b* form second attachment means which engage with first attachment means 36 on stringers 30. Each notch 47*a* is formed with an outwardly extending nub 48*a* and each notch 47*b* is formed with an outwardly extending nub 48*b* to increase the engagement length of the notches, and therefore, the force retaining the slat 40 to stringer 30. Attachment means 36 includes outwardly extending ears 35*a* (FIG. 5A) which engage in and retain complementarily shaped notches 47*a*, 47*b*. As shown in FIG. 7A, pairs of retaining projections 37 engage either side of nubs 48*a*, 48*b* to inhibit lateral movement of slats 40 along stringers 30 once pallet 20 is assembled. The engagement of ears 35*a* in notches 47*a*, 47*b* and the presence of projections 37*a*, 37*b* render the use of additional independent fasteners unnecessary. As depicted in FIGS. 9 and 9A, the notches 47*a*, 47*b* are slid along rails 36 of the two stringers 30 until the desired projections 37 capture the nubs 48*a*, 48*b* holding slat 40 in its intended position on stringer 40. As depicted in FIG. 10, the remaining slats 40 are assembled from the opposite end of the stringer being slid into place in the same manner.

Figure 8:
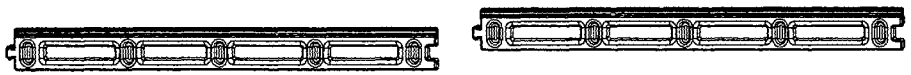
FIG. 8 is a side view of two longitudinally engageable stringers.
Figure 8A:
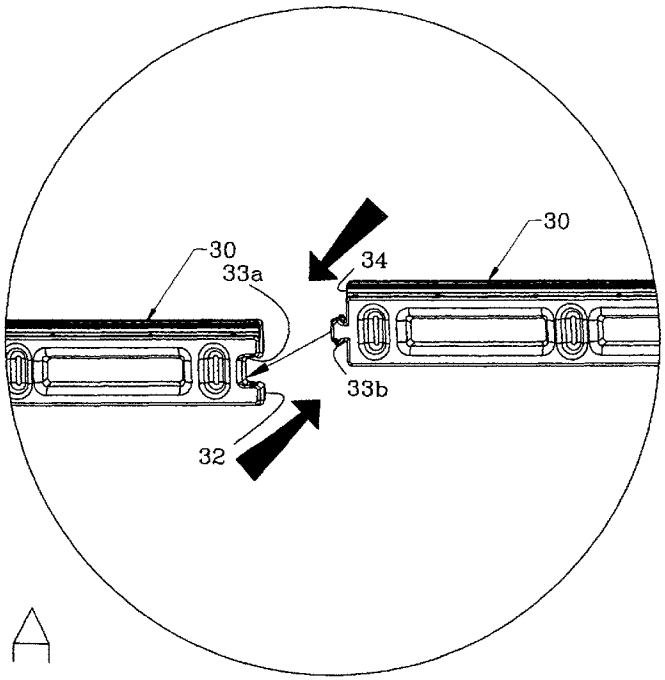
FIG. 8A is an enlarged closeup view of a portion of the rails shown in FIG. 8.

An additional feature of pallet 20 is set forth in FIGS. 8, 8A. As depicted there, a first end 32 of each stringer 30 is configured with a contoured notch 33*a* while opposite second end 34 is configured with a complementarily shaped contoured protrusion 33*b* which interlocks in contoured notch 33*a*. By this inter-engagement, the effective overall length of pallet 20 can be extended (doubled, initially) as often as the user desires. It will be appreciated that this inter-engagement is for purposes of enlarging the storage surface area and is not intended to permit transport of palletized goods while adjacent pallet sections 20 are interconnected.

Plastic pallet 20 of the present invention provides a layman the opportunity to assemble the plurality of slats 40 onto the stringers 30 without the use of tools and attach as many sections together as desired to a provide storage platform in garages, basements, or attics.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A plastic pallet comprising a) at least two longitudinally extending stringers defining a length of said plastic pallet;

b) a plurality of laterally extending slats interconnected to said at least two longitudinally extending stringers, each said slat having a first overall length and comprising i. a longitudinal upper face extending substantially said first overall length of said slat;

ii. four-sided open-box construction including a side extending downwardly and tapering outwardly from each edge of said longitudinal upper face;

iii. a series of ribs each said rib protruding from a lower surface of said upper face extending downwardly a limited extent into said open-box construction;

whereby, prior to assembly with said at least two longitudinally extending stringers, said slats may be nested to form a stack.

2. The plastic pallet of claim 1 in which each of said at least two longitudinally extending stringers further comprises a first end of each said stringer having a contoured notch and a second end having a complementarily shaped contoured protrusion which interlocks in said contoured notch effectively extending said length of said plastic pallet.

3. The plastic pallet of claim 1 further comprising a. first attachment means formed on an upper surface of each of said longitudinally extending stringers;

b. each of said plurality of laterally extending slats having a series of second attachment means formed on a lower surface of each said laterally extending slat, said series of second attachment means being equal in number to said plurality of longitudinally extending stringers;

whereby said second attachment means of each of said plurality of laterally extending slats can be secured to said first attachment means of each of said plurality of longitudinally extending stringers to secure each of said laterally extending slats to said longitudinally extending stringers without utilizing any additional independent fasteners.

4. The plastic pallet of claim 3 wherein said second series of attachment means comprises a series of aligned notches, each of said notches including a pair of laterally extending nubs.

5. The plastic pallet of claim 4 further comprising a pair of retaining projections formed along said first attachment means, said pair of retaining projections engaging said laterally extending nubs of said slats to maintain said slats in a desired position along said stringer.

6. A plastic pallet comprising a) at least two longitudinally extending stringers defining a length of said plastic pallet, a first end of each said stringer having a contoured notch and a second end having a complementarily shaped contoured protrusion which interlocks in said contoured notch effectively extending said length of said plastic pallet;

b) a plurality of laterally extending slats interconnected to said at least two longitudinally extending stringers, each of said plurality of laterally extending slats having a first overall length and comprising i. a longitudinal upper face extending substantially said first overall length of said slat;

ii. four-sided open-box construction including a side extending downwardly and tapering outwardly from each edge of said longitudinal upper face;

iii. a series of ribs each said rib protruding from a lower surface of said upper face extending downwardly a limited extent into said open-box construction;

whereby, prior to assembly with said at least two longitudinally extending stringers, said slats may be nested to form a stack.

7. The plastic pallet of claim 6 further comprising a. first attachment means formed on an upper surface of each of said longitudinally extending stringers;

b. each of said plurality of laterally extending slats having a series of second attachment means formed on a lower surface of each said laterally extending slat, said series of second attachment means being equal in number to said plurality of longitudinally extending stringers;

whereby said second attachment means of each of said plurality of laterally extending slats can be secured to said first attachment means of each of said plurality of longitudinally extending stringers to secure each of said laterally extending slats to said longitudinally extending stringers without utilizing any additional independent fasteners.

8. The plastic pallet of claim 7 wherein said second series of attachment means comprises a series of aligned notches, each of said notches including a pair of laterally extending nubs.

9. The plastic pallet of claim 8 further comprising a pair of retaining projections formed along said first attachment means, said pair of retaining projections engaging said laterally extending nubs of said slats to maintain said slats in a desired position along said stringer.

10. A plastic pallet comprising:

a) a plurality of longitudinally extending stringers defining a length of said plastic pallet, first attachment means formed on an upper surface of each of said longitudinally extending stringers;

b) a plurality of laterally extending slats having a series of second attachment means formed on a lower surface of each said laterally extending slat, said series of second attachment means being equal in number to said plurality of longitudinally extending stringers, each of said plurality of laterally extending slats having a first overall length and comprising i. a longitudinal upper face extending substantially said first overall length of said slat;

ii. four-sided open-box construction including a side extending downwardly and tapering outwardly from each edge of said longitudinal upper face;

iii. a series of ribs each said rib protruding from a lower surface of said upper face extending downwardly a limited extent into said open-box construction;

whereby said second attachment means of each of said plurality of laterally extending slats can be secured to said first attachment means of each of said plurality of longitudinally extending stringers to secure each of said laterally extending slats to said longitudinally extending stringers without utilizing any additional independent fasteners and whereby, prior to assembly with said at least two longitudinally extending stringers, said slats may be nested to form a stack.

11. The plastic pallet of claim 10 further comprising in which each of said at least two longitudinally extending stringers further comprises a first end of each said stringer having a contoured notch and a second end having a complementarily shaped contoured protrusion which interlocks in said contoured notch effectively extending said length of said plastic pallet.

12. The plastic pallet of claim 10 wherein said second series of attachment means comprises a series of aligned notches, each of said notches including a pair of laterally extending nubs.

13. The plastic pallet of claim 12 further comprising a pair of retaining projections formed along said first attachment means, said pair of retaining projections engaging said laterally extending nubs of said slats to maintain said slats in a desired position along said stringer.

* * * * *